US008920892B2

(12) United States Patent
Hernandez

(10) Patent No.: US 8,920,892 B2
(45) Date of Patent: Dec. 30, 2014

(54) CONTAINER HAVING A ROLLED RIM, AND METHOD OF MAKING THE SAME

(75) Inventor: Jeffery J. Hernandez, Victor, NY (US)

(73) Assignee: Pactiv LLC, Lake Forest, IL (US)

( * ) Notice: Subject to any disclaimer, the term of this patent is extended or adjusted under 35 U.S.C. 154(b) by 1441 days.

(21) Appl. No.: 12/410,359

(22) Filed: Mar. 24, 2009

(65) Prior Publication Data

US 2010/0247830 A1 Sep. 30, 2010

(51) Int. Cl.
*B32B 1/02* (2006.01)
*B65D 1/26* (2006.01)
*B32B 1/08* (2006.01)

(52) U.S. Cl.
CPC ..... *B65D 1/265* (2013.01)
USPC ..... 428/35.7; 428/34.1; 428/34.2; 428/35.9; 428/36.9

(58) Field of Classification Search
USPC ..... 428/34.1, 34.2, 35.7, 35.9, 36.9
See application file for complete search history.

(56) References Cited

U.S. PATENT DOCUMENTS

| | | | | |
|---|---|---|---|---|
| 1,636,174 | A | 7/1927 | Dolan et al. | |
| 2,016,434 | A | 10/1935 | Huntley | |
| 2,743,834 | A * | 5/1956 | Williams | 215/354 |
| 3,091,360 | A | 5/1963 | Edwards | |
| 3,126,139 | A | 3/1964 | Schechter | |
| 3,139,213 | A | 6/1964 | Edwards | |
| D199,579 | S | 11/1964 | Davis | |
| 3,157,335 | A | 11/1964 | Maier | |
| 3,223,305 | A | 12/1965 | Edwards | |
| 3,288,340 | A | 11/1966 | Shapiro et al. | |
| 3,342,370 | A | 9/1967 | Johnson | |
| D210,767 | S | 4/1968 | Anglada | |
| D211,514 | S | 6/1968 | Amberg | |
| D213,174 | S | 1/1969 | Davis | |
| 3,437,253 | A | 4/1969 | Davis et al. | |
| 3,893,567 | A | 7/1975 | Davis et al. | |
| 3,947,205 | A | 3/1976 | Edwards | |
| 4,061,782 | A | 12/1977 | Baxter | |
| 4,111,303 | A | 9/1978 | Compton | |

(Continued)

FOREIGN PATENT DOCUMENTS

| | | |
|---|---|---|
| DE | 1175564 | 8/1964 |
| DE | 9412997 | 10/1994 |

(Continued)

OTHER PUBLICATIONS

Photograph 1 of Berry Plastics cup for McDonalds, side view and cross cut, circa 2008.

(Continued)

*Primary Examiner* — Marc Patterson
(74) *Attorney, Agent, or Firm* — Baker Botts LLP

(57) ABSTRACT

A blank for a container having a rolled rim, comprising a hollow body of polyolefin material, having an open first end and an opposite second end with a sidewall extending between the first end and the second end, and a rim formed at the first end of the hollow body. The rim includes a flange extending outwardly from the sidewall, the flange defining a flange thickness and having an inner portion proximate the sidewall and an outer portion opposite the inner portion. The rim further includes a skirt extending downwardly from the outer portion of the flange, the skirt defining a skirt thickness and having an upper portion proximate the flange and a lower portion opposite the upper portion, the flange thickness being greater than the skirt thickness.

37 Claims, 4 Drawing Sheets

(56) References Cited

U.S. PATENT DOCUMENTS

| | | | | |
|---|---|---|---|---|
| 4,226,358 | A * | 10/1980 | Ottow | 220/4.24 |
| 4,245,685 | A | 1/1981 | Nemitz et al. | |
| 4,261,501 | A | 4/1981 | Watkins et al. | |
| 4,420,081 | A | 12/1983 | Dart | |
| 5,415,339 | A | 5/1995 | Howard | |
| 6,006,677 | A | 12/1999 | Apps et al. | |
| 6,010,062 | A * | 1/2000 | Shimono | 229/400 |
| D484,362 | S | 12/2003 | Harris et al. | |
| D499,935 | S | 12/2004 | Smith et al. | |
| 7,736,740 | B2 * | 6/2010 | Tang et al. | 428/403 |
| 2003/0157224 | A1 | 8/2003 | Westerhof et al. | |
| 2004/0031714 | A1 | 2/2004 | Hanson | |
| 2004/0107637 | A1 * | 6/2004 | Sieverding | 47/83 |
| 2006/0076395 | A1 * | 4/2006 | Hayes et al. | 229/400 |
| 2006/0226162 | A1 | 10/2006 | Hayes et al. | |

FOREIGN PATENT DOCUMENTS

| | | | |
|---|---|---|---|
| DE | 20109219 | | 9/2001 |
| EP | 0371918 | | 11/1989 |
| EP | 1112710 | | 7/2001 |
| FR | 2207836 | | 6/1974 |
| GB | 983906 | | 11/1963 |
| GB | 974241 | | 11/1964 |
| GB | 1085536 | | 10/1967 |
| GB | 1096451 | | 12/1967 |
| GB | 1251595 | | 10/1971 |
| GB | 1264114 | | 2/1972 |
| GB | 1266909 | | 3/1972 |
| GB | 1461394 | | 1/1977 |
| GB | 1564097 | | 4/1980 |
| GB | 2073581 | | 10/1981 |
| GB | 2104473 | * | 3/1983 |
| JP | 6135444 | | 5/1994 |

OTHER PUBLICATIONS

Photograph 2 of Berry Plastics cup for McDonalds, side view with cut out, circa 2008.

Photograph 3 of Berry Plastics cup for McDonalds, side view with cut out, circa 2008.

Photograph 4 of Berry Plastics cup for McDonalds, bottom view, circa 2008.

* cited by examiner

CONTAINER HAVING A ROLLED RIM, AND METHOD OF MAKING THE SAME

FIELD OF THE INVENTION

The present invention relates generally to the field of thermoformed containers, specifically, the construction of a blank for a container such as a cup, bowl or the like. More specifically, the present invention relates to a blank for a container to include a rolled rim and a method of making a blank.

BACKGROUND OF THE INVENTION

A variety of thermoplastic containers, such as containers for food and beverages, are well known in the art. Such thermoplastic containers are relatively inexpensive and disposable; and therefore are extremely popular. Such containers are often used at parties, picnics, gatherings, and other occasions where minimal clean-up is desired.

Containers made of thermoplastic materials are particularly advantageous for both manufacturers and consumers. Such containers are generally more durable than paper containers, yet inexpensive, lightweight, and recyclable.

Thermoforming generally begins with a thin sheet or web of material such as polyethylene, polypropylene, polyester, or polystyrene having a thickness within a range of from approximately 8 mils to 100 mils, depending on the size of the container to be manufactured. Cups and similar articles are typically made from plastic sheet or web having a pre-thermoforming thickness from approximately 30 to 60 mils, but the finished articles may be thinner after thermoforming. The sheet or web is heated to a temperature suitable for thermoforming—such as, for example, in a range from approximately 110° C. to about 200° C. for the above-mentioned materials—and is thereafter fed into a conventional forming assembly in which the process proceeds under applied positive and/or negative air pressure conditions. Depending on the thermoforming process, whether melt phase or solid phase, oven temperatures can vary and can reach up to 485° C. in melt phase thermoforming. A mold cavity is used to impart a particular shape to define the thin-walled container as the plastic sheet or web is drawn into the mold using vacuum pressure on one side of the sheet or web and/or a positive pressure on the opposite surface of the sheet or web. A plug assist can be used to aid in the process of imparting a particular shape to define the thin-walled container. The container generally includes a sidewall, and may also be provided with a rim or lip along the mouth of the container. The shape of the container may be decorative, but generally has a particular utility—e.g., ribs for strength, texturing for grasping, and formations for nestability in addition to other utilities. The processing period for a normal thermoforming operation can be between 1 and 20 seconds.

One disadvantage of many existing thermoformed cup and container designs is the lack of structural integrity in the sidewall and the rim. Sidewalls and rims of thin-walled thermoformed containers often bend and deflect inward easily. A deflection of this sort may constrict the volume of the container or cause spillage and overflows. Additionally, deflection of the sidewall can make the container more difficult to grip, as well as potentially leading to cracking of the container sidewall.

An additional disadvantage of many existing cup and container designs is that if provided, the rim may have a squared-off edge. Such a rim is not preferable because the sharp edges of the squared-off edge may be uncomfortable to the touch and germs may collect under the rim when it is not completely rolled, rendering it unsanitary. Alternatively, rolled rim configurations eliminate the disadvantages of squared-off rims or flanges, as well as add rigidity to the overall rim. A rolled rim on a container can additionally improve the fit of a lid onto the container rim.

A rolled rim can add significant rigidity to the rim as well as to close the space created at the rim. Such rolled rims have been created in containers formed of alkenyl aromatic polymeric materials such as polystyrene. There are numerous reasons, such as cost and consumer preference, to make consumer containers out of polyolefin polymer materials. However, polyolefin polymer materials become significantly softer than do alkenyl aromatic polymers during the thermoforming process. Due to the softness of polyolefin polymer material during thermoforming, such materials are not conducive to rim rolling processes. Thus, a need further exists for a blank for a container having a rolled rim that can be formed of a polyolefin material.

The present invention provides a solution to the recognized problems. The present invention is intended to provide a suitable blank for a container having a rolled rim made of polyolefin material, and a method for forming the same.

SUMMARY OF THE INVENTION

The purpose and advantages of the present invention will be set forth in and apparent from the description that follows, as well as will be learned by practice of the invention. Additional advantages of the invention will be realized and attained by the methods and systems particularly pointed out in the written description and claims hereof, as well as from the appended drawings.

In accordance with an aspect of the present invention, a blank is provided for a container having a rolled rim, comprising a hollow body of polyolefin material. The hollow body has an open first end and an opposite second end with a sidewall extending between the first end and the second end, and a rim formed at the first end of the hollow body. The rim includes a flange extending outwardly from the sidewall, the flange defining a flange thickness and having an inner portion proximate the sidewall and an outer portion opposite the inner portion. The rim further includes a skirt extending downwardly from the outer portion of the flange, the skirt defining a skirt thickness and having an upper portion proximate the flange and a lower portion opposite the upper portion, the flange thickness being greater than the skirt thickness.

In accordance with another aspect of the present invention, a method is provided for forming a blank for a container having a rolled rim, comprising providing a sheet of thermoformable polyolefin material, and thermoforming the sheet of thermoformable polyolefin material to form a hollow body. The hollow body has an open first end and an opposite second end with a sidewall extending between the first end and the second end, and a rim formed at the first end of the hollow body. The rim includes a flange extending outwardly from the sidewall, the flange defining a flange thickness and having an inner portion proximate the sidewall and an outer portion opposite the inner portion. The rim further includes a skirt extending downwardly from the outer portion of the flange, the skirt defining a skirt thickness and having an upper portion proximate the flange and a lower portion opposite the upper portion, the flange thickness being greater than the skirt thickness.

The flange thickness can be at least about twice the skirt thickness. The skirt thickness can vary between the upper portion and the lower portion. For example, the skirt thickness can decrease from the upper portion to the lower portion, such as to define a taper, the taper being approximately 3 degrees from normal. Additionally, the outer portion of the flange and the upper portion of the skirt can form a joint therebetween. The joint can include an upper surface having an outer radius and a lower surface having an inner radius, the outer radius being at least about twice the inner radius. In a preferred embodiment, the outer radius is approximately 0.033 inches and the inner radius is approximately 0.016 inches. Preferably, the joint defines a hinge point between the skirt and the flange. For example, the joint can define a joint thickness that is less than the flange thickness. As embodied herein, the flange extends outward from the sidewall at approximately 90 degrees from the sidewall, and the skirt, prior to the rim being rolled, extends at an angle of approximately 90 degrees from the flange. In a preferred embodiment, the flange has a width between the inner portion and the outer portion of at least approximately 0.165 inches. The polyolefin material can be selected from: polypropylene, high-density polyethylene, foamed polyolefin material, or blends thereof. The container is: a cup, a plate, a bowl, a lid, or similar configuration, preferably made of a single piece.

It is to be understood that both the foregoing general description and the following detailed description are exemplary and are intended to provide further explanation of the invention claimed.

The accompanying drawings, which are incorporated in and constitute part of this specification, are included to illustrate and provide a further understanding of the method and system of the invention. Together with the description, the drawings serve to explain the principles of the invention.

DETAILED DESCRIPTION OF THE INVENTION

Reference will now be made in detail to the embodiments of the invention, an example of which is illustrated in the accompanying drawings.

Disclosed herein is a blank for a container having a rolled rim. The blank includes a hollow body of polyolefin material, having an open first end and an opposite second end with a sidewall extending between the first end and the second end, and a rim formed at the first end of the hollow body. The rim includes a flange extending outwardly from the sidewall, the flange defining a flange thickness and having an inner portion proximate the sidewall and an outer portion opposite the inner portion. The rim further includes a skirt extending downwardly from the outer portion of the flange, the skirt defining a skirt thickness and having an upper portion proximate the flange and a lower portion opposite the upper portion, the flange thickness being greater than the skirt thickness.

The blank can be for a wide variety of containers, including but not limited to beverage cups, food containers, plates, and lids.

Figure 1B:
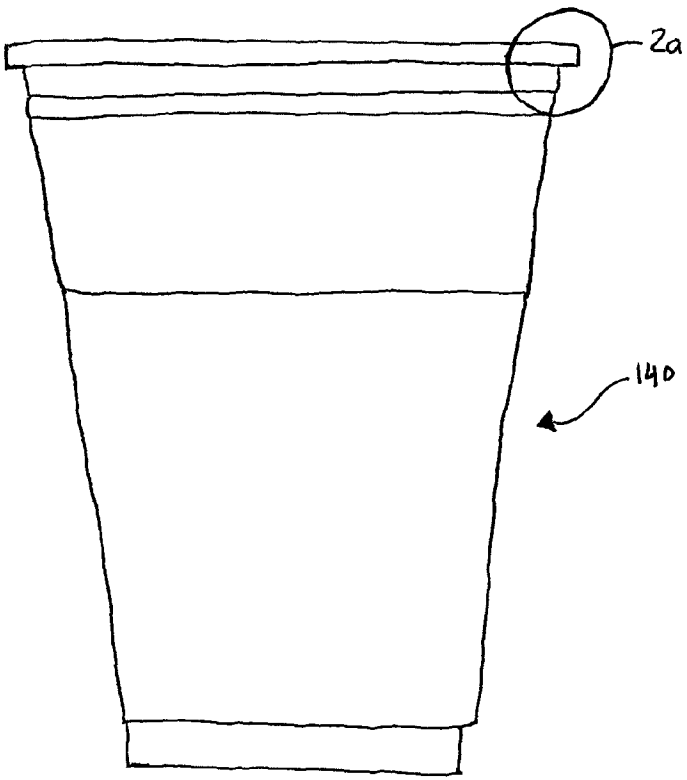
FIG. 1*b* is side view of a blank for a container having a rolled rim, prior to having the rim rolled, according to an aspect of the present invention.
Figure 1A:
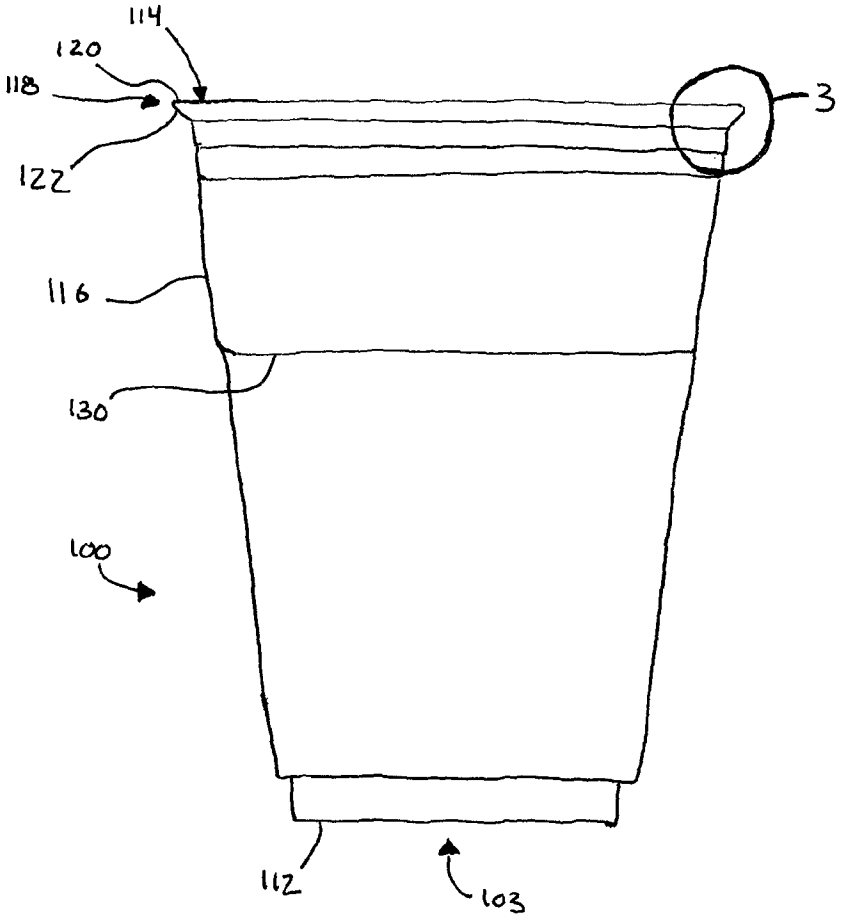
FIG. 1*a* is a side view of a container having a rolled rim and formed from a blank according to an aspect of the present invention.

For purpose of explanation and illustration, and not limitation, an exemplary container having a rolled rim in accordance with the invention is shown in FIG. 1*a* as is designated by reference character 100. FIG. 1*a* shows a thermoformed cup made from a blank in accordance with the invention. While the present invention is particularly designed for use in thermoformed cups, other types of containers may also be capable of utilizing and benefiting from the disclosed invention.

As embodied herein and depicted in FIG. 1*a*, the container 100 has a bottom wall 112 defining a closed bottom 103. Container has an open end or mouth 114 formed opposite the bottom wall 112. Container 100 includes a sidewall 116 extending from bottom wall 112 to mouth 114. The bottom wall 112 and sidewall 116 define a receptacle space capable of holding contents in the container 100.

The sidewall as embodied herein, is substantially cylindrical, and can be frustoconical, in shape, as shown generally in FIG. 1*a*. However, the sidewall can be configured to have a variety of other shapes, including but not limited to rectangular, rounded, hexagonal, or octagonal polyhedronal shapes. In accordance with an aspect of the invention, as depicted in FIG. 1*a*, the sidewall 116 has an upwardly and outwardly extending taper. Accordingly, the diameter of mouth 114 is greater than the diameter of bottom wall 112. Alternatively, however, the sidewall 116 can be configured such that the diameter of the mouth 114 can be substantially the same as that of bottom wall 112, if desired.

The dimensions of sidewall 116 depend on the particular application. For example and not limitation, if the container is an 32 ounce beverage cup, sidewall 116 can have a height approximately 4.5 inches, and a radius at the base of approximately 1 inch and a radius at the mouth of approximately 2 inches.

In accordance with an aspect of the invention, as shown in FIG. 1*a*, the sidewall 116 can be configured to include at least one ridge 130 disposed circumferentially about a surface of the sidewall 116, if desired. Additionally, a plurality of ridges 130 and other features or elements can be disposed circumferentially about the sidewall 116 of container 100 for a variety of functions, as disclosed in, for example, U.S. Patent Application Publication No. 2006/0226162, which is incorporated herein by reference.

In accordance with the invention, mouth 114 of container 100 includes an annular rolled rim 118. The rolled rim 118 can have a substantially planar top surface 120, and a rolled outer surface 122, as depicted in FIG. 1*a*. The rolled outer surface 122 is rolled at least partially under the substantially planar top surface 120. The configuration of the rolled rim 118 therefore can have a generally triangular configuration. Alternatively, the rolled rim can have a folded-over or generally parallel configuration. Conventional manufacturing equipment and methods can be used to roll the rim in a container, such as those disclosed in U.S. Pat. No. 3,947,205, which is incorporated herein by reference. However, the present invention can be adapted to any number of rim rolling processes.

Figure 2A:
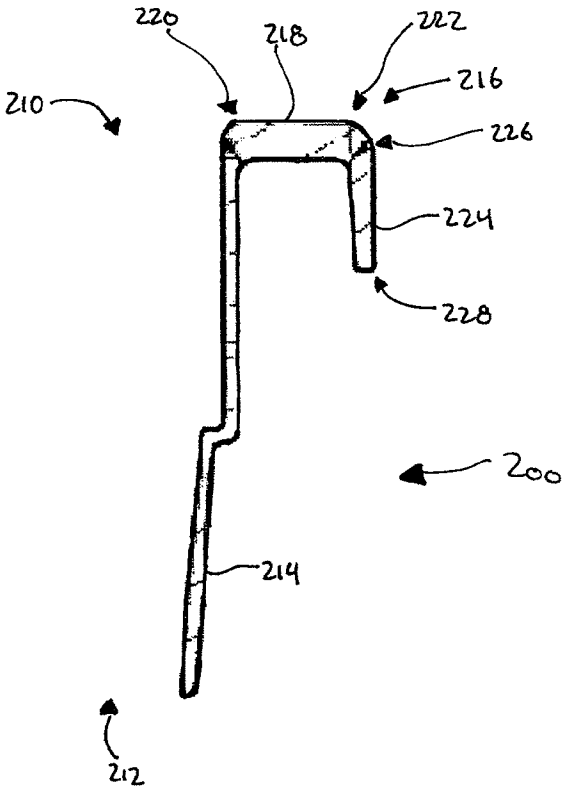
FIG. 2*a* is a partial cross sectional side view of a first end of a blank having an unrolled rim according to an aspect of the present invention corresponding to the detail 2*a*-2*a* of the blank shown in FIG. 1*b*.
Figure 2B:
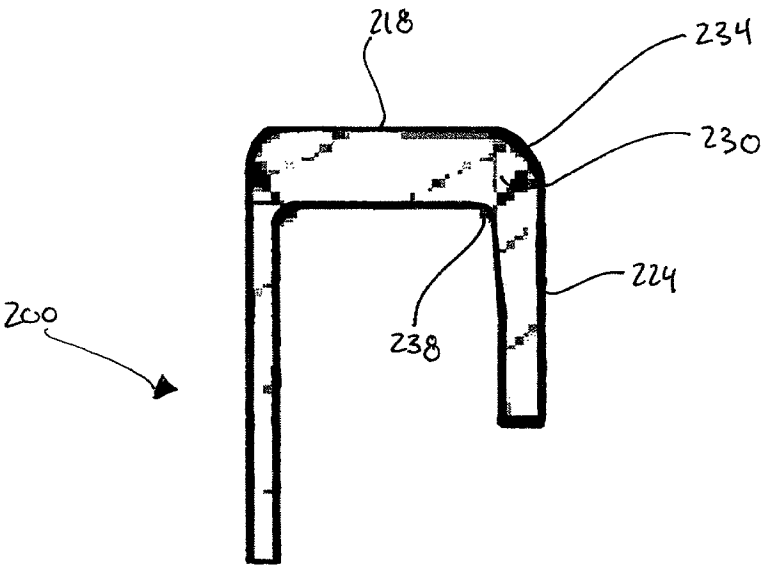
FIG. 2*b* is an enlarged cross sectional side view of FIG. 2*a*.

In order to create a container having a rolled rim and made of a polyolefin material, the present invention provides a blank 140 for such a container, as shown in FIG. 1*b*. For purposes of explanation and illustration, and not limitation, a portion of a blank 140 in accordance with the invention is depicted in FIGS. 2*a* and 2*b*. Particularly, FIGS. 2*a* and 2*b* show a detail view 2*a*-2*a* at a first end of the blank, such as at the upper end or mouth of a cup. The remaining portion of blank 140 will define the general shape of the container to be formed unless further forming steps are defined after rim rolling occurs.

In order to create a blank in accordance with the invention, a sheet of thermoformable polyolefin material is provided and thermoformed to create a hollow body 200, a portion of which is shown in FIG. 2*a*. A variety of systems and techniques are known to thermoform a sheet of polyolefin material into the general configuration of a blank for a container. As shown in FIG. 2*a*, hollow body 200 includes an open first end 210 and an opposite second end 212, with a sidewall 214 extending between first end 210 and second end 212. Hollow body 200 includes a rim 216 formed at the first end 210 of the hollow body 200. As embodied herein, hollow body 200 preferably is a single piece and is closed at second end 212 to define a bottom wall. As further embodied herein, sidewall 214 is approximately 0.015 inches thick, although any suitable thickness can be used.

In accordance with the invention, the blank and thus the container is made of a polyolefin material. Examples of suitable polyolefin materials include, but are not limited to polypropylene polymers, such as, for example polypropylene homopolymers, polypropylene random copolymers, or polypropylene impact polymers, ethylene polymers, such as, for example, high density polyethylene, medium density polyethylene, or low density polyethylene, and mixtures, copolymers, monolayer, laminated multilayer, or coextruded multilayer combinations thereof. Polyolefin materials, while exhibiting excellent characteristics for containers such as thermoformed cups and plates, become very soft during thermoforming and when heated generally are not capable of undergoing traditional rim forming and rim rolling techniques.

In order to create a polyolefin container with a rolled rim, the present invention provides a blank having a first end as shown in FIG. 2*a*, including rim 216. The rim includes a flange 218 extending outwardly from the sidewall 214 a distance relatively larger than conventional blanks. The flange 218 is of a thickness and width sufficient for additional subsequent processing to roll the rim 216. The flange 218 has an inner portion 220 proximate the sidewall 214 of the hollow body 200, and an outer portion 222 opposite the inner portion 220. Rim 216 additionally includes a skirt 224 extending downwardly from the outer portion 222 of the flange 218. The skirt 224 has a skirt thickness and length sufficient for additional subsequent processing to roll the rim 216. The skirt 224 has an upper portion proximate 226 proximate the flange 218 and a lower portion 228 opposite the upper portion 226.

In accordance with an aspect of the invention, the thickness of the flange 218 is greater that the skirt thickness. For example, as embodied herein, the thickness of flange 218 preferably is at least about twice the skirt thickness. The greater thickness of flange 218 relative to the skirt thickness allows the rim to endure the heat or pressure applied during the rim rolling process. For purpose of illustration and not limitation, the thickness of flange 218 can be approximately 0.040 inches, and the skirt thickness can be approximately 0.020 inches, as embodied herein with reference to a 32 ounce cup. Additionally, and in accordance with an aspect of the invention, the flange extends from the sidewall a relatively larger distance than conventional blanks. For example, the flange 218 for a 32 ounce cup has a width extending from inner portion 220 to outer portion 222 that is at least approximately 0.165 inches.

In accordance with another aspect of the invention, the skirt thickness can vary between the upper portion 226 and the lower portion 228. For example, the skirt thickness can decrease from the upper portion 226 of the skirt 224 to the lower portion 228 of the skirt 224 to define a taper on the skirt 224. Particularly, for purpose of illustration, the taper of the skirt 224 can be approximately 3 degrees from normal. In the preferred embodiment for a blank for a 32 ounce cup, the skirt 224 has a length from upper portion 226 to lower portion 228 of approximately 0.158 inches, although other suitable dimensions can be used.

In accordance with another aspect of the invention, the flange 218 and the upper portion 226 of the skirt 224 form a joint 230 at an interface therebetween as shown in FIG. 2*b*. Preferably, the joint defines a hinge point between the skirt 224 and the flange 218. The joint 230 includes an upper surface having an outer radius 234 and a lower surface having an inner radius 238. In accordance with another aspect of the invention, the outer radius 234 is at least about twice the inner radius 238. With reference to the configuration of a blank for an 32 ounce cup, for purpose of illustration, outer radius 234 is approximately 0.033 inches and the inner radius 238 is approximately 0.016 inches. As such, the joint 230 preferably has a joint thickness less than the thickness of flange 218.

As shown in FIGS. 2*a* and 2*b*, the flange 218 extends at an angle of approximately 90 degrees from the sidewall 214, and the skirt extends from flange 218 at an angle of approximately 90 degrees. However, the flange and skirt can extend at an angle other than 90 degrees depending upon the rolled rim configuration desired.

Figure 3:
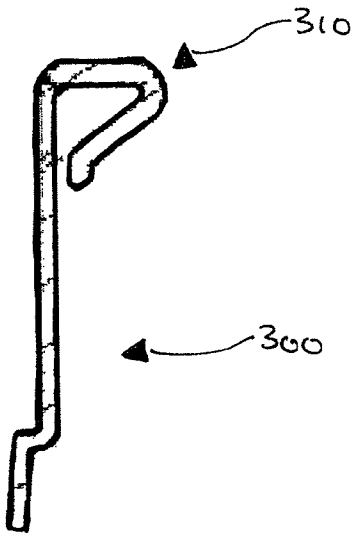
FIG. 3 is a partial cross-sectional side view of a first end of a container having a rolled rim according to an aspect of the present invention corresponding to the detail 3-3 of the container shown in FIG. 1*a*.

A polyolefin blank 200 configured in accordance with this invention can be processed by conventional rim rolling technique to create a container with a rolled rim, as shown in FIG. 1. For purpose of illustration, FIG. 3 depicts a cross section of a container 300 having a rolled rim 310 made using a blank in accordance with the present invention. The blank of the present invention has a geometry that allows such a blank made of polyolefin material to be processed by known rim rolling techniques as detailed below.

In accordance with an aspect of the invention, the rolled rim 118 can be formed of polyolefin blank by known rim rolling techniques. Such techniques are disclosed in U.S. Pat. No. 3,947,205, which is incorporated herein by reference. Generally, a stack of nested blanks is fed into a conveyor, which directs the blanks into a space between a set of rotating feed rollers. The feed rollers engage the rims of the blanks and rotate the stack of nested blanks. The blanks are thereby advanced into the interior of a heated oven having a heating source, such as for example a calrod, or a convectional, radiant, or other heat source. The stack of nested blanks are headed in the oven, and then are directed to a set of rotating forming screws. The forming screws engage the heated rims of the blanks and progressively fold a portion of the rims inward and downward (i.e., towards sidewall 214) to create the rolled rim of each container.

In accordance with another aspect of the invention, the polyolefin material can include at least one filler and/or other additives. An exemplary type of additive that can be included in the polyolefin material is a colorant. Such a colorant can be any suitable material capable of providing suitable color or hue, as well as white and black, to the material of the container. The colorants that can be used in the present invention include, but at not limited to, pigments or dyes. The colorants may be used in a variety of modes, including but not limited to, dry color, conventional color concentrates, liquid color and precolored resin. The colorant can be provided in a sufficient concentration to provide the desired color. Other suitable fillers or additives include, but are not limited to talc, calcium carbonate, barium sulfate, wollastonite, mica, clay, kaolin or combinations thereof. For example, the polyolefin material may comprise talc, calcium carbonate and polypropylene. A polyolefin material comprising at least one particulate mineral filler and polypropylene is often more economical than the same non-filled neat polyolefin material.

It will be apparent to those skilled in the art that various modifications and variations can be made in the method and system of the present invention without departing from the spirit or scope of the invention. Thus, it is intended that the present invention include modifications and variations that are within the scope of the appended claims and their equivalents.

What is claimed is:

1. A container having a rolled rim, comprising:

a hollow body of a thermoformed sheet consisting essentially of unfoamed polyolefin material, having an open first end and an opposite second end with a sidewall extending between the first end and the second end;

a rigid rolled rim formed of the unfoamed polyolefin material at the first end of the hollow body, the rigid rolled rim including a flange extending outwardly from the sidewall, the flange defining a flange thickness and having an inner portion proximate the sidewall and an outer portion opposite the inner portion, the rigid rolled rim further including a skirt extending downwardly from the outer portion of the flange toward the sidewall, the skirt defining a skirt thickness and having an upper portion proximate the flange and a lower portion opposite the upper portion, the flange thickness being greater than the skirt thickness.

2. The container of claim 1, wherein the flange thickness is at least about twice the skirt thickness prior to being rolled.

3. The container of claim 1, wherein the skirt thickness varies between the upper portion and the lower portion prior to being rolled.

4. The container of claim 3, wherein the skirt thickness decreases from the upper portion to the lower portion.

5. The container of claim 4, wherein the skirt thickness decreases from the upper portion to the lower portion defining a taper, the taper is approximately 3 degrees from normal.

6. The container of claim 1, wherein the outer portion of the flange and the upper portion of the skirt form a joint therebetween prior to being rolled.

7. The container of claim 6, wherein the joint includes an upper surface having an outer radius and a lower surface having an inner radius, the outer radius being at least about twice the inner radius.

8. The container of claim 7, wherein the outer radius is approximately 0.033 inches and the inner radius is approximately 0.016 inches.

9. The container of claim 6, wherein the joint defines a hinge point between the skirt and the flange.

10. The container of claim 6, wherein the joint defines a joint thickness, the joint thickness is less than the flange thickness.

11. The container of claim 1, wherein the flange extends outward from the sidewall at approximately 90 degrees from the sidewall.

12. The container of claim 1, wherein the skirt extends at an angle of approximately 90 degrees from the flange prior to being rolled.

13. The container of claim 1, wherein the flange has a width between the inner portion and the outer portion of at least approximately 0.165 inches.

14. The container of claim 1, wherein the container is selected from: a cup, a plate, a bowl, and a lid.

15. The container of claim 1, wherein the second end is closed to define a bottom wall.

16. The container of claim 1, wherein the hollow body is a single piece.

17. A method for forming a container having a rolled rim, comprising:

providing a thermoformable sheet consisting essentially of unfoamed polyolefin material;

thermoforming the sheet of unfoamed polyolefin material to form a hollow body having an open first end and an opposite second end with a sidewall extending between the first end and the second end, and a rim formed at the first end of the hollow body, the rim including a flange extending outwardly from the sidewall, the flange defining a flange thickness and having an inner portion proximate the sidewall and an outer portion opposite the inner portion, the rim further including a skirt extending downwardly from the outer portion of the flange, the skirt defining a skirt thickness and having an upper portion proximate the flange and a lower portion opposite the upper portion, the flange thickness being greater than the skirt thickness; and rolling the rim to form a rigid rolled rim along the open first end of the hollow body, wherein the skirt extends toward the sidewall after being rolled.

18. The method of claim 17, wherein the flange thickness is at least about twice the skirt thickness prior to being rolled.

19. The method of claim 17, wherein the skirt thickness varies between the upper portion and the lower portion prior to being rolled.

20. The method of claim 19, wherein the skirt thickness decreases from the upper portion to the lower portion.

21. The method of claim 20, wherein the skirt thickness decreases from the upper portion to the lower portion defining a taper, the taper is approximately 3 degrees from normal.

22. The method of claim 17, wherein the outer portion of the flange and the upper portion of the skirt form a joint therebetween prior to being rolled.

23. The method of claim 22, wherein the joint includes an upper surface having an outer radius and a lower surface having an inner radius, the outer fadius being at least about twice the inner radius.

24. The method of claim 23, wherein the outer radius is approximately 0.033 inches and the inner radius is approximately 0.016 inches.

25. The method of claim 22, wherein the joint defines a hinge point between the skirt and the flange.

26. The method of claim 22, wherein the joint defines a joint thickness, the joint thickness is less than the flange thickness.

27. The method of claim 17, wherein the flange extends outward from the sidewall at approximately 90 degrees from the sidewall.

28. The method of claim 17, wherein the skirt extends at an angle of approximately 90 degrees from the flange prior to being rolled.

29. The method of claim 17, wherein the flange has a width between the inner portion and the outer portion of at least approximately 0.165 inches.

30. The method of claim 17, wherein the container is selected from: a cup, a plate, a bowl, and a lid.

31. The method of claim 17, wherein the second end is closed to define a bottom wall.

32. The method of claim 17, wherein the hollow body is a single piece.

33. The container of claim 1, wherein the polyolefin material is selected from: polypropylene, high-density polyethylene, or blends thereof.

34. The method of claim 17, wherein the polyolefin material is selected from: polypropylene, high-density polyethylene, or blends thereof.

35. The container of claim 1, wherein the polyolefin material includes at least one of filler or additive.

36. The method of claim 17, wherein the polyolefin material includes at least one of filler or additive.

37. The container of claim 1, wherein the container is formed from a blank.

* * * * *